US006012401A

United States Patent [19]

Orita et al.

[11] Patent Number: 6,012,401

[45] Date of Patent: Jan. 11, 2000

[54] WATER PIPE PROTECTING REFRACTORY STRUCTURE

[75] Inventors: Norihiko Orita; Yuji Nakagawa; Takeo Takaishi; Tetsuo Takahashi; Chuhachi Goto; Yuzo Kawahara; Minoru Ike; Yasuhiro Terashima; Keita Inoue, all of Yokohama, Japan

[73] Assignee: Mitsubishi Heavy Industries, Ltd., Tokyo, Japan

[21] Appl. No.: 09/051,445

[22] PCT Filed: Jul. 29, 1997

[86] PCT No.: PCT/JP97/02626

§ 371 Date: Sep. 28, 1998

§ 102(e) Date: Sep. 28, 1998

[87] PCT Pub. No.: WO98/05901

PCT Pub. Date: Dec. 2, 1998

[30] Foreign Application Priority Data

Aug. 7, 1996 [JP] Japan ..... 8-224407

[51] Int. Cl.[7] ..... F23M 9/00; F23M 9/10

[52] U.S. Cl. ..... 110/325; 110/323; 122/503; 122/510; 122/DIG. 13

[58] Field of Search ..... 110/325, 322, 110/323, 324, 336, 337; 122/503, 510, 511, 512, DIG. 13

[56] References Cited

FOREIGN PATENT DOCUMENTS 7-225016A 8/1995 Japan .
8-178242A 7/1996 Japan .

*Primary Examiner*—Ira S. Lazarus
*Assistant Examiner*—Ljiljana V. Ciric
*Attorney, Agent, or Firm*—Evenson, McKeown, Edwards & Lenahan, P.L.L.C.

[57] ABSTRACT

A heat-resistant assembly to shield boiler tubes which does not entail a thick heat-resistant block. This structure would be interposed between the boiler tubes and the combustion gases. Such a structure would be distinguished by the fact that it comprises heat-resistant block 16, itself composed of curved portion 16*a*, whose inner surface at one point comes in contact with the aforesaid boiler tube 11, and connecting portions 16*b*, and the aforesaid boiler tube assembly 12. The interlocking attachment structure which interlockingly secures these two components together in such a way that the block can be mounted or removed comprises recess 17, 58 or 68 and tongue 18, 59 or 69.

6 Claims, 8 Drawing Sheets

Fig. 5
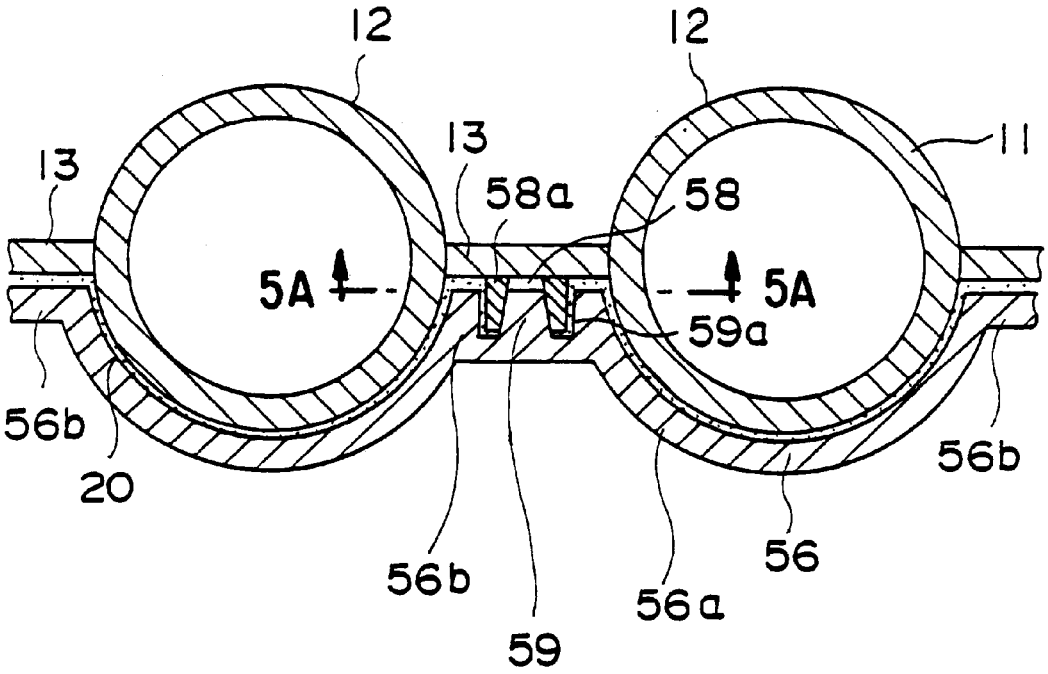
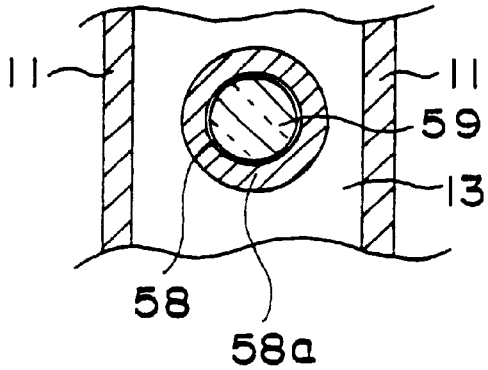
Fig. 5A

Fig. 7
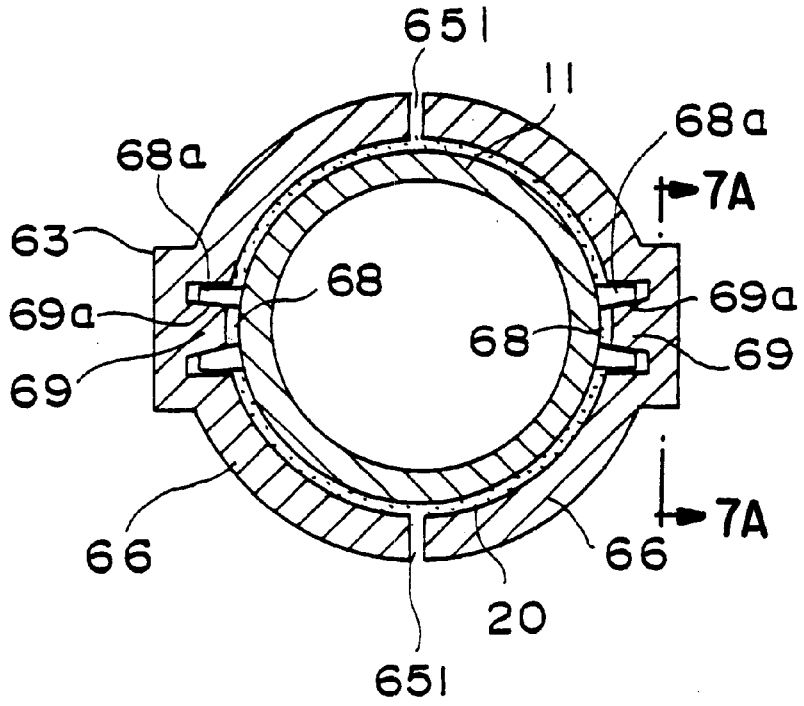
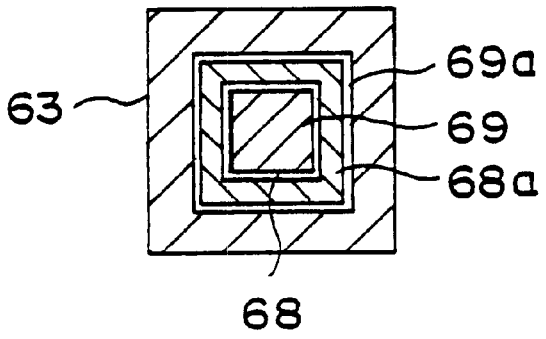
Fig. 7A

WATER PIPE PROTECTING REFRACTORY STRUCTURE

TECHNICAL FIELD

This invention concerns a heat-resistant assembly for the tubes in a boiler such as a waste heat boiler which uses the heat from a garbage incinerator. More specifically, it concerns a heat-resistant design for a block of boiler tubes in a plant which obtains steam energy from a boiler using the exhaust gas from combusting garbage or industrial waste.

TECHNICAL BACKGROUND

Heat-resistant structures for protecting boiler tubes in waste heat boilers are well known in the prior art. For example, in Patent Publication 2-203194, as is shown in FIG. 9, boiler tubes 101 are connected by fins 102 to form tube walls 100. Panels 104 are constructed of heat-resistant brick. The areas between the upper surfaces of panels 104 and the surfaces of tube walls 100 which face towards the gas and the areas between each pair of adjacent tubes are filled with mortar 107. The panels are fixed to tube walls 100 by means of stud bolt 103. The end of the aforesaid stud bolt 103 which is exposed is covered by cap 110, also constructed of heat-resistant brick.

This prior art design requires that a depression 109 be provided in heat-resistant panel 104 to contain cap 110. This resulted in an extremely thick panel 104 with very low heat conductivity.

This problem was addressed in Japanese Patent Publication 4-227401, wherein the design pictured in FIG. 8 was proposed. A heat-resistant block provides a composite structure for the boiler tubes while insuring a good conductive transfer of heat. To explain FIG. 8 more fully, it shows a heat-resistant design for a set of boiler tubes to recover the waste heat from a garbage incinerator. This design protects the tubes from both the heat of the combustion exhaust gases and the corrosive atmosphere.

In the drawing, 11 are boiler tubes and 13 are flat ribs to lend strength to the tubes 11 by connecting them in either a horizontal or a vertical array. 12 is a boiler tube assembly consisting of a number of rows of tubes 11 and the flat ribs 13 which connect the adjacent tubes 11 in either a horizontal or a vertical array.

Reference numeral 26 identifies heat-resistant blocks of a ceramic material which are placed so as to protect the aforesaid tubes 11 from the combustion gases. The aforesaid tubes 11 are protected from the heat of the combustion exhaust gases and the corrosive atmosphere they create by the heat-resistant blocks 26.

23*a* is a bolt to affix the aforesaid block 26 onto one of the flat ribs 13. The bolt extends from rib 13 through heat-resistant block 26. When nut 23*b* is tightened, block 26 is fastened to tubes 11 and rib 13. 20 is mortar which fills the spaces between the heat-resistant block 26 and tubes 11 or ribs 13.

In the heat-resistant assembly of the prior art boiler described above, block 26 is composed of a highly heat-resistant ceramic, and the space between tubes 11 or ribs 13 and block 26 is filled with mortar 20. This promotes the flow of heat while protecting tubes 11 from the combustion gases and their corrosive atmosphere.

However, because the aforesaid prior art block is composed of a ceramic, its heat conductivity is relatively high. If only the portion around nut 23*b* is indented, and surface 26*a,* which faces the combustion gases, is to be flat, block 26 will necessarily have to be quite thick. As a result, boilers with the prior art design were not able to achieve the maximum heat flow which is essential to boiler efficiency.

Furthermore, because heat is not transferred efficiently from block 26 to tubes 11, a large temperature differential occurs between the interior and exterior of block 26, and the temperature of surface 26*a,* the surface which is exposed to the combustion gases, gets quite high. This results in a thermal expansion differential between tubes 11 (which are composed of a heat-resistant metal) and heat-resistant block 26 (which is composed of a ceramic). The end result is that block 26 experiences high thermal stress.

If the ideal conditions are not met for heat transfer between the assembly of block 26 and tubes 11, the temperature of the exterior surface of block 26 will increase, and the residual ash 24 of the combusted fuel will melt and adhere to the block, forming a layer of thermal insulation.

Because the heat transfer capability of this layer of ash is extremely inadequate, once ash 24 begins to adhere, the further melting and buildup of ash is promoted and the layer of insulation becomes thicker and thicker, posing a significant obstacle to heat transfer. And because ash 24 contains corrosive components such as chlorine compounds, tubes 11 are exposed to high-temperature corrosion which may result in damage.

The aforesaid heat-resistant block 26 is attached to tubes 11 and flat ribs 13 by bolt 23, which is fixed to one of the flat ribs 13. The compression which occurs when the bolt 23 is tightened and the difference in thermal expansion between tubes 11 (which are composed of heat-resistant metal) and block 26 (which is composed of a ceramic) may result in thermal warping. This stress and the thermal stress due to the temperature differential between the interior and exterior of block 26 may result in damage to the block.

The aforesaid bolt 23*a* and nut 23*b* are exposed to the combustion gases, which are liable to corrode them. If the corrosion is allowed to proceed, heat-resistant block 26 may be damaged or fall away from the boiler tubes.

DISCLOSURE OF THE INVENTION

This invention was developed in view of the problems discussed above. Its objective is to provide a heat-resistant assembly which would not entail a thick block, which would experience less thermal stress, which would not suffer from high-temperature corrosion of its mounting fittings and so would provide a longer service life, and which could transfer heat very efficiently.

Another objective of this invention is to provide a heat-resistant assembly which would not experience the problems which occurred with prior art devices, including damage due to warping of the block, inefficient heat transfer due to the thickness of the mortar, and high-temperature corrosion of the securing means used to attach the block to the tube assembly.

This invention relates to a heat-resistant assembly which protects the boiler tubes from the products of combustion by interposing a heat-resistant block between the tubes and the combustion gases.

The heat-resistant assembly comprises a block and an interlocking attachment means. The inner side of the block faces the aforesaid tube assembly. The block is formed so as to effectively shield the tubes from the combustion gases. At least one of its surfaces, that which faces the tube assembly, is curved. The interlocking attachment means is to securely fix, so as to be detachable, the block and the tube by mortar, in other words, the interlocking attachment means is located between the aforesaid tube assembly and the heat-resistant block.

This invention is distinguished by the fact that the aforesaid boiler tube assembly and heat-resistant block are interlockingly secured to each other by the interlocking attachment means.

The meaning of the phrase "boiler tubes" is not limited to the boiler tubes only. It also includes the fittings which connect the tubes and the flat ribs or the entire tube assembly.

For the purposes of this invention, the aforesaid boiler tubes preferably comprise at least two tubes and the flat rib which joins them.

The heat-resistant blocks comprise curved portions which conform to the shape of the aforesaid tubes and ribs, and flat portions which connect the curved portions. The invention is distinguished by the fact that the heat-resistant block is interlockingly secured to the tube assembly, in such a way that it can freely be installed or removed, by an interlocking attachment means mounted in one of the flat portions where the rib of the aforesaid tube assembly faces the heat-resistant block.

This invention is also applicable to a boiler in which adjacent tubes are not connected by flat ribs but are installed independent of each other in the chamber containing the combustion gases.

In this case, the aforesaid heat-resistant block comprises an assembly of a number of curved shroud portions cut along the axial direction which, when combined, cover the entire periphery of the aforesaid tubes.

The invention is distinguished by the fact that the shroud portions are attached to the tube, in such a way that they can easily be installed or removed, by interlocking attachment means mounted where the shroud portions face the outer surface of the tube.

With the present invention, the shroud which encases the boiler tubes does not have a square cross section like that of a prior art shroud with a flat surface facing the combustion gases. Rather, its shape follows the contour of the tube surface. This allows the heat-resistant block to be made thinner, and it prevents the temperature of the block from spiking because of the large differential between its interior and exterior or because of heat absorbed by the boiler tubes. This design thus reduces the thermal stress experienced by the heat-resistant block.

As has been discussed, the block is of a uniform thickness, so its thermal conductivity is high. It can efficiently transfer thermal energy to the boiler tubes. Excess heat cannot be trapped in the block, and ash does not accumulate on the surface of the block which is exposed to the combustion gases, as occurred with prior art devices. As a result, the thermal conductivity of the block remains high.

The aforesaid prior art heat-resistant block pictured in FIG. 8 is relatively thick, and its thickness is not uniform. For this reason it is liable to warp due to thermal stress. The heat-resistant block according to the present invention is of a relatively thin and uniform thickness and is formed of arc-shaped segments. In addition to addressing the aforesaid problems, this design mitigates thermal stress. Because the block is thin and uniform and conforms to the cylindrical shape of the tubes, it can conduct heat to the tubes more efficiently and so improve the thermal efficiency of a steam generator plant.

The aforesaid interlocking attachment means is not exposed in the chamber containing the combustion gases, but instead is on the side of the block which faces the boiler tubes. In other words, it is completely insulated from the combustion gases. The boiler tubes are able to absorb heat more effectively, so that even though they are metal, they pose no problem in terms of heat transfer. This provides greater freedom for the design of the interlocking attachment means.

The block is not attached to the tube assembly using the compressive force of a bolt and nut as in the prior art, but is held by interlocking the two members securely. This design is thus virtually free of the thermal constraint which occurs between the tubes and the block due to the bolt and nut. If a thermal lag occurs because of the differential in thermal expansion between the two components, this lag will effectively be absorbed so that thermal warping will not occur. The design naturally prevents thermal damage.

Because, unlike prior art devices, this design does not employ a bolt and nut which are exposed to the combustion gases, it is not subject to high-temperature corrosion.

The aforesaid anchor to be used in the present invention should be as described below.

To wit, the aforesaid interlocking attachment means comprises a tongue and recess which are provided on the aforesaid heat-resistant block and tube assembly, respectively. When the tongue engages in the recess, the block is interlockingly secured to the tube assembly.

As can be seen in FIGS. 5 through 7, the tongue and recess constituting the aforesaid interlocking attachment means may both be tapered so that the block is securely fixed when the tongue is forced into the recess.

In other words, as can be seen in FIGS. 5 through 7, if the interlocking attachment means comprises a tapered tongue on the outer surface of the tube assembly and a tapered recess on the inner surface of the block, the block can be interlockingly secured by pressing the tongue into the recess.

Interlockingly securing the heat-resistant block to the tube assembly by forcing a tapered tongue into a tapered recess provides a simple mounting design which does not allow the block to draw away from the tubes. Because the interlocking attachment means can loosen and tighten, the exposed side of the block is free to experience thermal expansion without excessive thermal stress occurring.

If the present invention is applied to a tube assembly which comprise at least two tubes and a flat rib which links them, the heat-resistant block should comprise curved portions which conform to the shape of the aforesaid tubes and ribs and flat portions which connect the curved portions. Even if the interlocking attachment means, comprising a tapered tongue and recess, is placed where the flat portion of the block is up against the flat rib of the tube assembly, it should still engage in such a way that its tongue and recess can become loosely interlockingly attached. This allows for a certain amount of thermal expansion in the vicinity of the interlocking attachment means so that the block will not experience excessive thermal stress.

Instead of the aforesaid tapered tongue and recess, the interlocking attachment means may comprise a projection on the inner surface of the curved portion of the block which engages with the outer surface of the tube.

According to this configuration, the aforesaid projection engages so closely with the outer surface of the tube that corrosive gases are prevented from entering the interlocking attachment means from the combustion gas chamber. Also, the gap between the block and the tube assembly is uniform, so there is no point where the mortar which fills the gap can get too thick.

According to this configuration, the aforesaid interlocking attachment means comprises a tongue which projects from the tube assembly in the direction opposite the force of gravity and a recess on the heat-resistant block in which the tongue engages. The block, then, is interlockingly secured to the tube assembly using the force of gravity. More specifically, the aforesaid heat-resistant block is mounted to the aforesaid boiler tube assembly in the same way that a picture is hung on the wall.

According to this configuration of the present invention, the block is affixed to the tube assembly, in the same way that a picture is hung on the wall, by an interlocking attachment means comprising a tongue and recess. This design eliminates the need for the bolt and nut employed in the prior art. Because the block is hung on the tube assembly, as it were, there is leeway for thermal expansion between the tubes and the block, and thermal compression will not occur. The block can be made thinner, and significant temperature differentials between the inner and outer surfaces of the block or incidents of local spiking can be kept to a minimum. This will reduce the thermal stress experienced by the block.

The heat-resistant block of the aforesaid invention should have a number of curved shroud portions, each of which shields a single tube in an array of tubes consisting of several (preferably two) rows. Each shroud portion should be affixed to the aforesaid tube by means of a single interlocking attachment means. The block can be made thinner and smaller. Because it is affixed to the tube by a single interlocking attachment means, it is easy to mount and remove. It is also easier to handle (i.e., to carry).

BRIEF DESCRIPTION OF THE DRAWINGS

FIG. 5 is a radial cross section of another heat-resistant shield for protecting boiler tubes which is a preferred embodiment of this invention.

FIG. 7 is a horizontal cross section of the heat-resistant shield for protecting boiler tubes shown in FIG. 6.

EMBODIMENTS

In this section we shall discuss in detail two preferred embodiments of this invention with reference to the drawings. To the extent that the dimensions, material, shape or relative position of the structural components which are mentioned in these examples is not specifically disclosed, the invention is not limited only to the example given, which is meant merely for the purpose of illustration.

We shall first discuss a preferred embodiment of this invention with reference to FIGS. 1 through 4.

Figure 1:
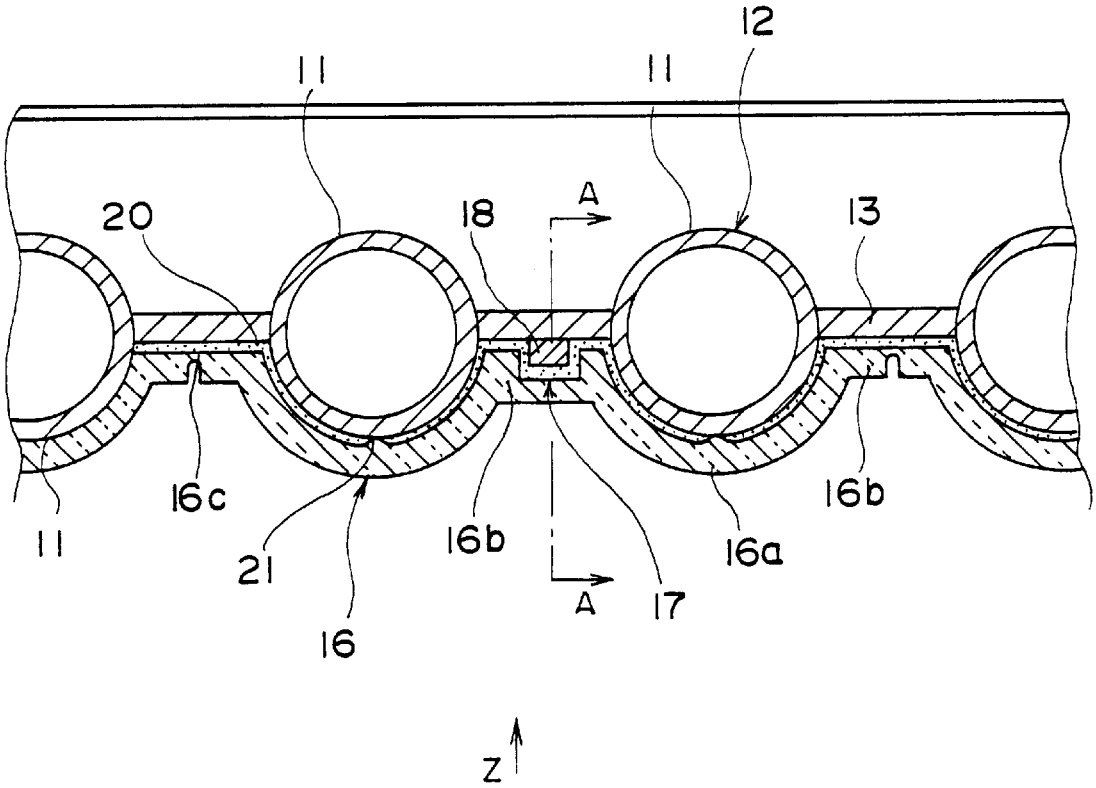
FIG. 1 is a radial cross section of a heat-resistant shield for protecting the tubes in a waste heat boiler which is a preferred embodiment of this invention.
Figure 2:
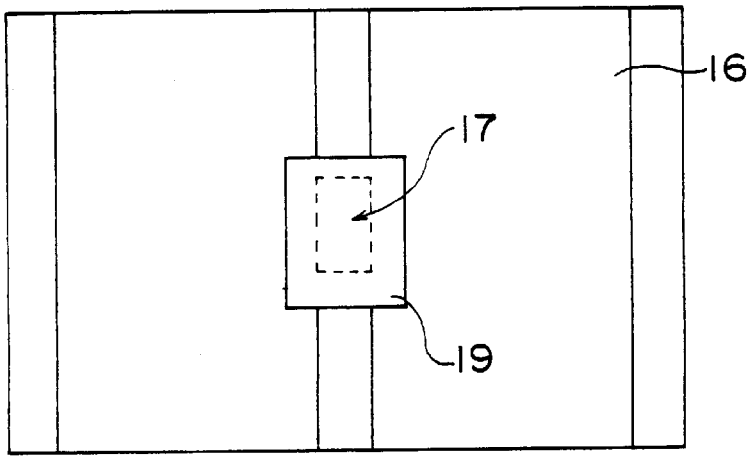
FIG. 2 is a view of the principal parts of the shield in FIG. 1 from the direction indicated by arrow Z.
Figure 3:
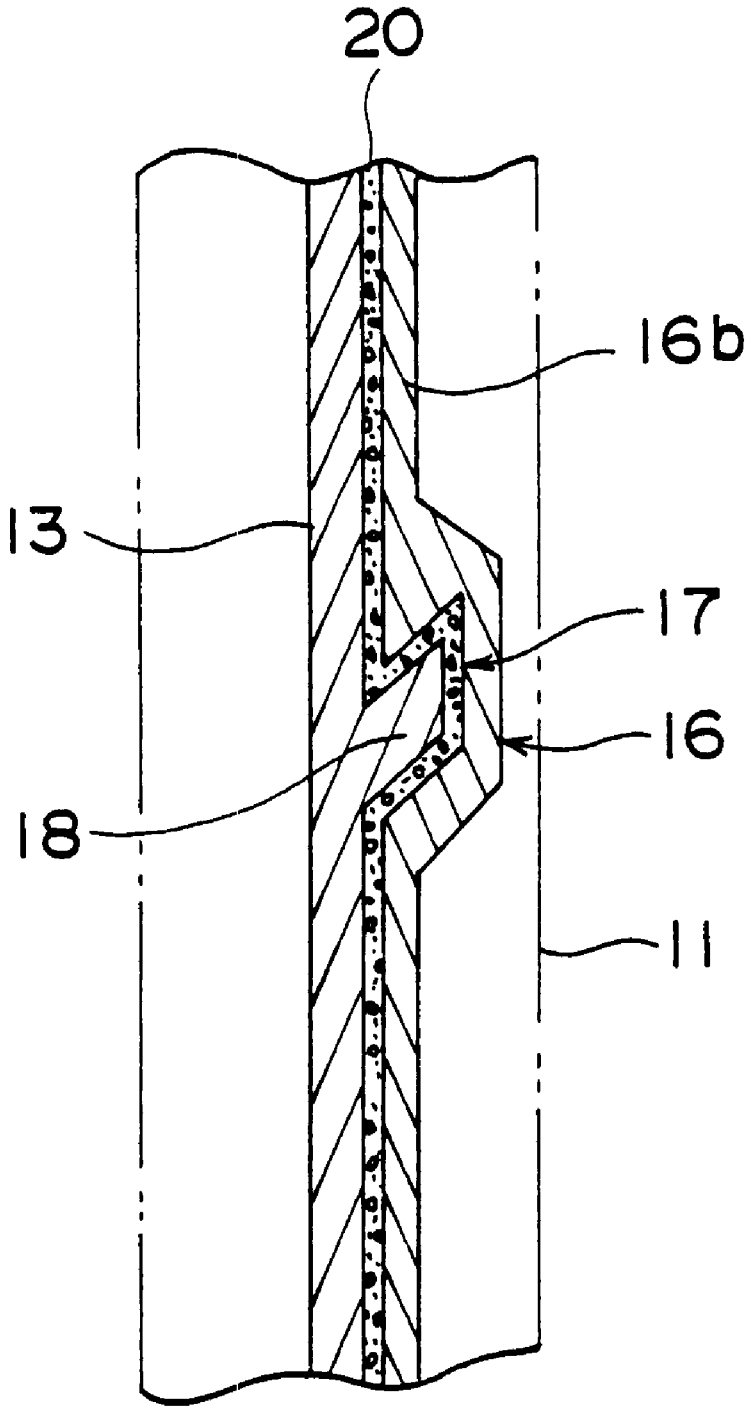
FIG. 3 is a cross section taken along line A—A in FIG. 1.

FIG. 1 is a horizontal cross section of a heat-resistant shield for the tubes in a waste heat boiler which is a first embodiment of this invention. FIG. 2 is a view of the shield in FIG. 1 as seen from the direction indicated by arrow Z. FIG. 3 is a cross section taken along line A—A in FIG. 1.

FIGS. 1 through 4 show cross sections of a combustion chamber for a boiler. This chamber is a high-temperature incinerator for garbage or industrial waste. 12 is the boiler tube assembly, which comprises multiple rows of tubes 11 and flat ribs 13, which connect adjacent tubes 11 in either a horizontal or a vertical array.

16 is a heat-resistant block which shields the entire exposed surface of the aforesaid tube assembly 12 from the combustion gases. The heat-resistant block 16 is produced by placing in a mold a material with relatively good thermal conductivity, such as a castable material. The block comprises curved portions 16*a,* which shield the surface of the aforesaid boiler tubes 11, and flat connecting portions 16*b,* which extend from the curved portions 16*a* along the flat ribs 13 of the tube assembly.

Tongue 18 protrudes at an upward angle with a fixed pitch in the axial direction (i.e., vertically) from a flat rib 13 of the aforesaid boiler tube assembly 12. In the location which corresponds to tongue 18, block 16 has a collar 19 and a recess 17, into which tongue 18 can engage. Tongue 18 is interlockingly secured in recess 17 by means of mortar 20 and the force of gravity. When heat-resistant block 16 is hung in this fashion, it is fixed firmly to flat rib 13 of tube assembly 12.

Thus with the exception of the collar 19 which faces the aforesaid tongue 18, every part of the heat-resistant block 16 has the same thickness.

Ordinarily, one set of the aforesaid tongue 18 and the corresponding collar 19 and recess 17 in block 16 would be provided between two rows of boiler tubes 11; however, one set could also be provided for three or more rows of tubes.

The gap between the inner surface of curved portions 16*a* of the heat-resistant block 16 and the outer surface of the tubes 11, and that between the inner surface of flat connecting portions 16*b* and flat ribs 13 of the boiler are filled with a thin layer of mortar 20.

In the center of the inner periphery of curved portion 16*a* of the aforesaid block 16 is a protrusion 21 which is shaped like a flat mountain. A portion of the outer periphery of tube 11 comes in contact with the very top of the protrusion to assure that a secure connection is maintained between block 16 and tube 11.

The free ends of flat portions 16*b* of each heat-resistant block 16 are formed into the shape of a half-U, ending in horizontal protrusions 16*c,* a design which mitigates thermal stress.

Figure 4:
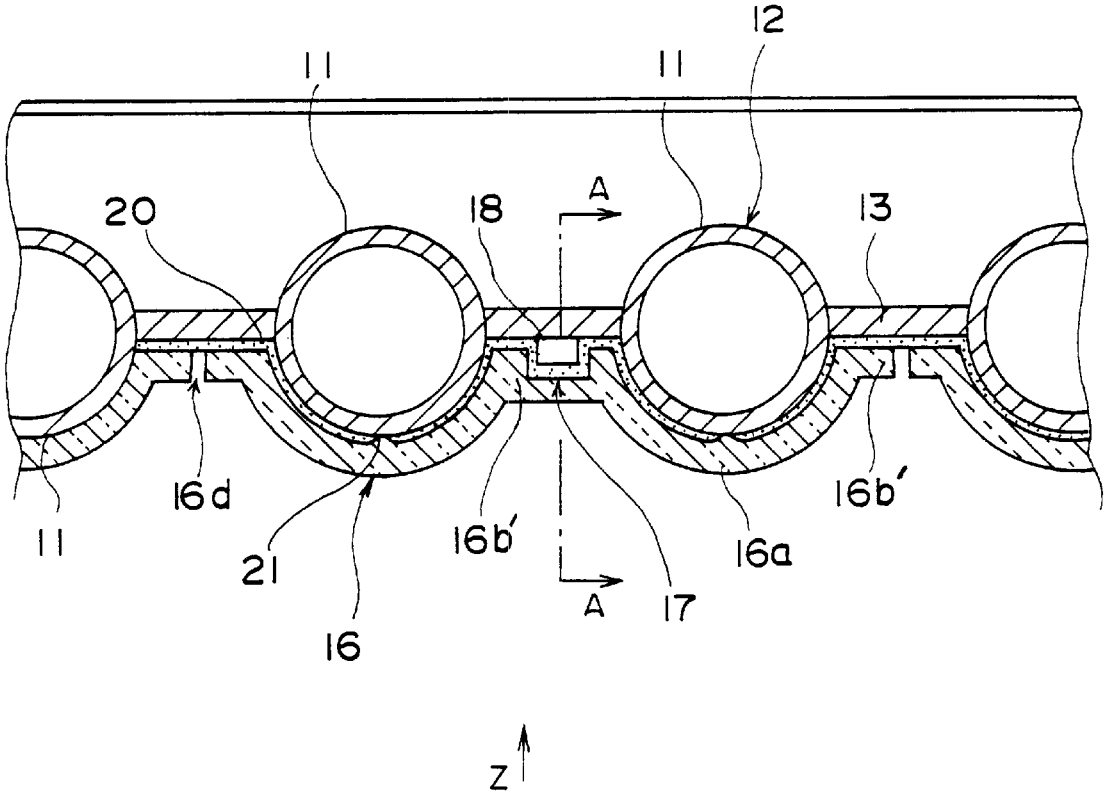
FIG. 4 shows a modification of the shield pictured in FIG. 1.

Instead of using U-shaped grooves to mitigate thermal stress, the free ends of flat portions 16*b* of the block can be separated by gaps with a specified clearance 16*d,* as shown in FIG. 4.

In this first embodiment of a heat-resistant shield for the boiler tubes, heat-resistant block 16 is interlockingly secured to flat rib 13 of boiler tube assembly 12 by inserting tongue 18 in recess 17 in the same way that one would hang a picture on the wall. It thus does not need to be mounted with a bolt and nut as prior art heat shields were. As a result there is no thermal compression between tube 11 (and flat rib 13) and the heat-resistant block, and thermal stress is minimized.

With the exception of collar 19, the thicker portion of the block in which recess 17 is formed to interlockingly secure the block to the tube assembly 12, heat-resistant block 16 is of a uniform thickness. This design provides excellent thermal conductivity. The thermal energy can be effectively transmitted to tubes 11, and the temperature differential between the interior and exterior surfaces of heat-resistant block 16 is reduced, thereby reducing the thermal stress on the block.

With the aforesaid heat-resistant block 16, boiler tube assembly 12 is completely shielded from the combustion gases by thin layer of mortar 20. Because there are no components such as bolts which are exposed to the combustion gases, high-temperature corrosion does not occur.

Because one segment of the aforesaid heat-resistant block 16 is provided for two rows of tubes 11, the block can be made thinner and smaller. The block can easily be handled (or carried), mounted or removed. And the fact that it mounts in picture-hanging fashion makes it even easier to interlockingly attach or remove.

Protrusion 21, formed on curved portion 16*a,* is in firm contact with the outer periphery of tube 11 to prevent any combustion gases which might cause high-temperature corrosion from gaining access to the tube assembly via the path between tongue 18 and recess 17. Because the gap between block 16 and tube assembly 12 is fixed and uniform, the mortar 20 used to fill the gap can be of an appropriate uniform thickness.

The length of horizontal protrusions 16*c* on the ends of each block segment 16 can be adjusted to maintain an appropriate gap between block 16 and tube assembly 12. When the opposed horizontal protrusions come in contact through thermal expansion, damage to the block is prevented.

Figure 6:
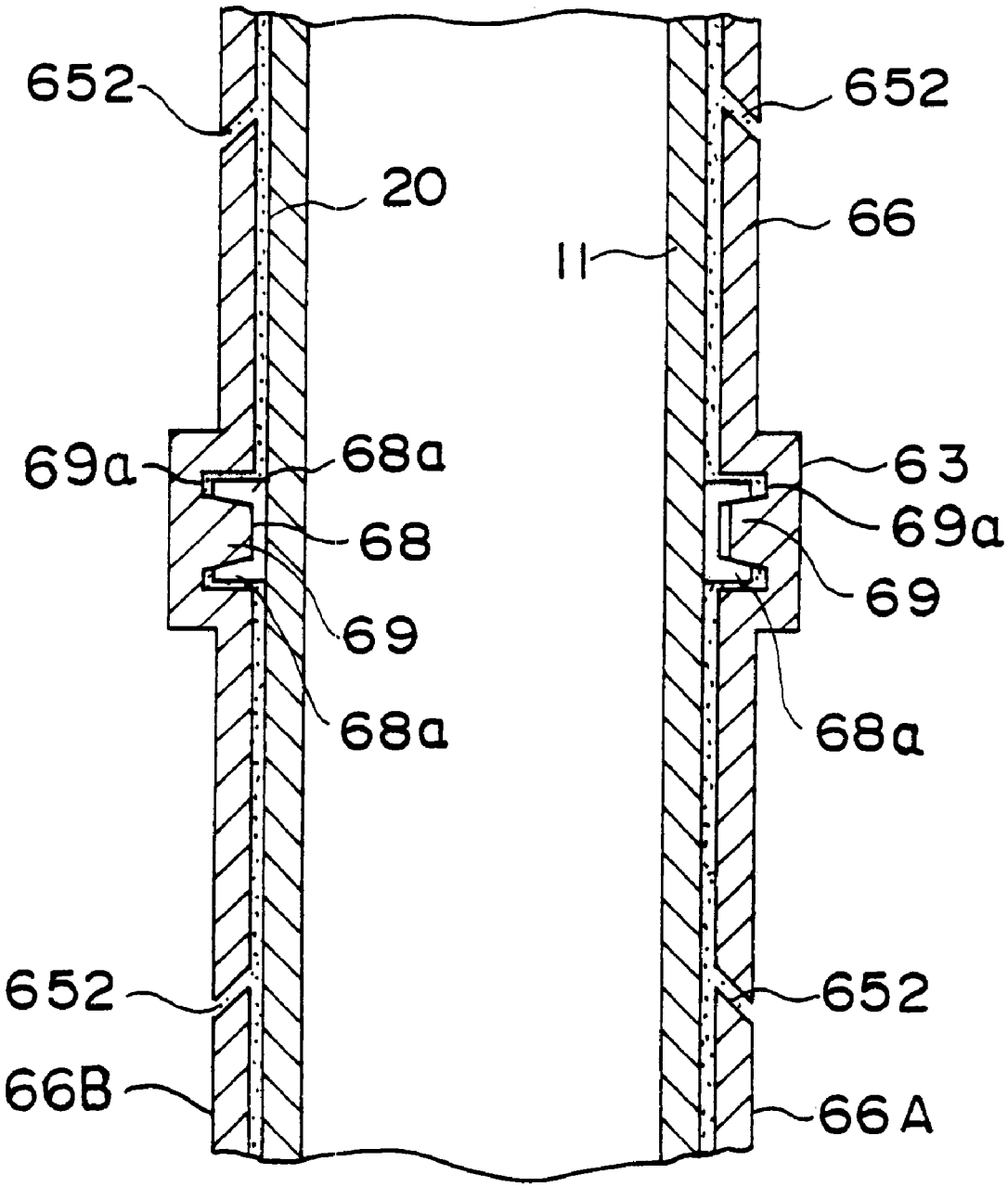
FIG. 6 is an axial cross section of still another heat-resistant shield for protecting boiler tubes which is a preferred embodiment of this invention.
Figure 8:
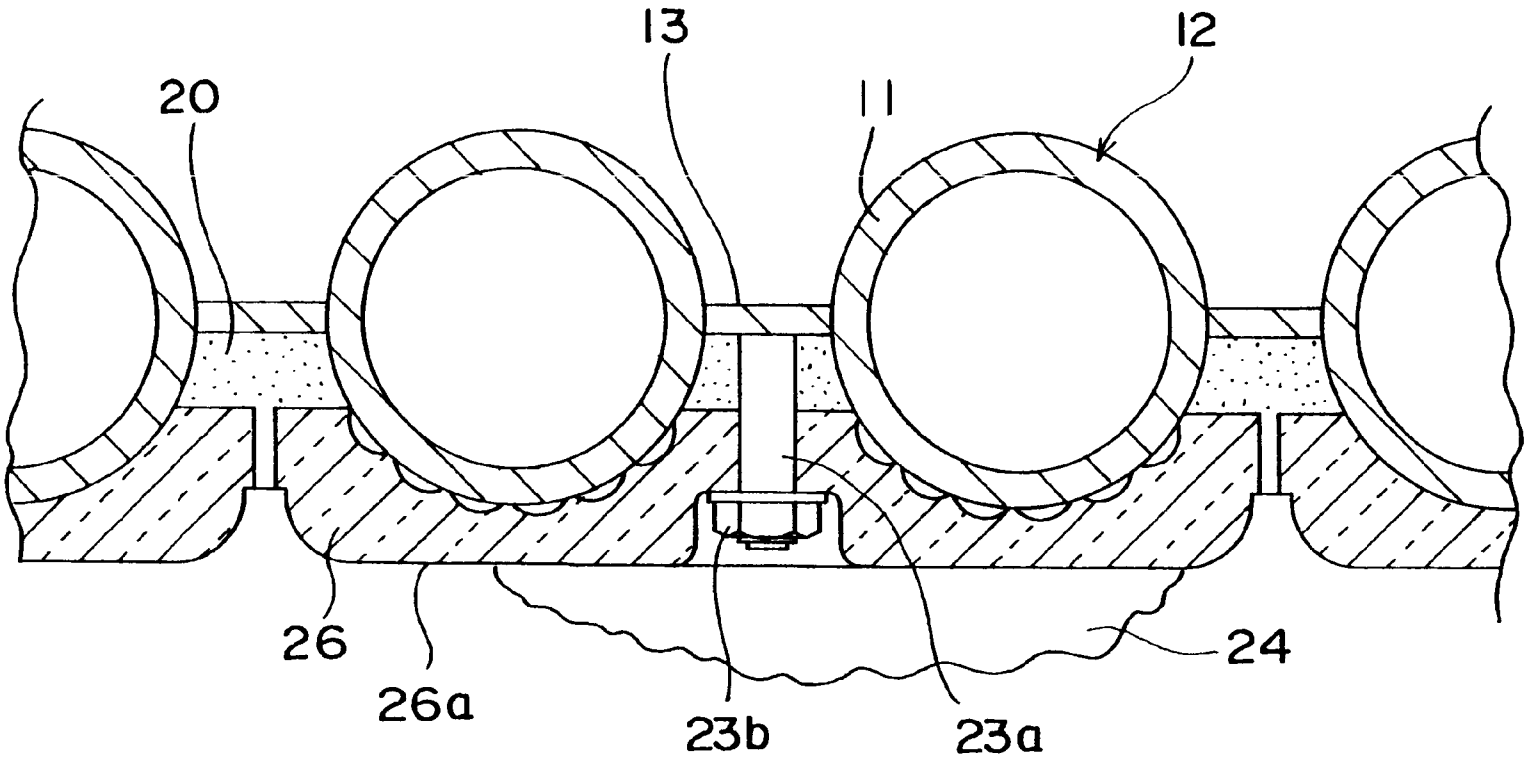
Fig. 8 PRIOR ART
FIG. 8 is a view corresponding to FIG. 1, showing a heat-resistant shield for protecting boiler tubes which is an example of the prior art (Patent Publication 4-227401).
Figure 9:
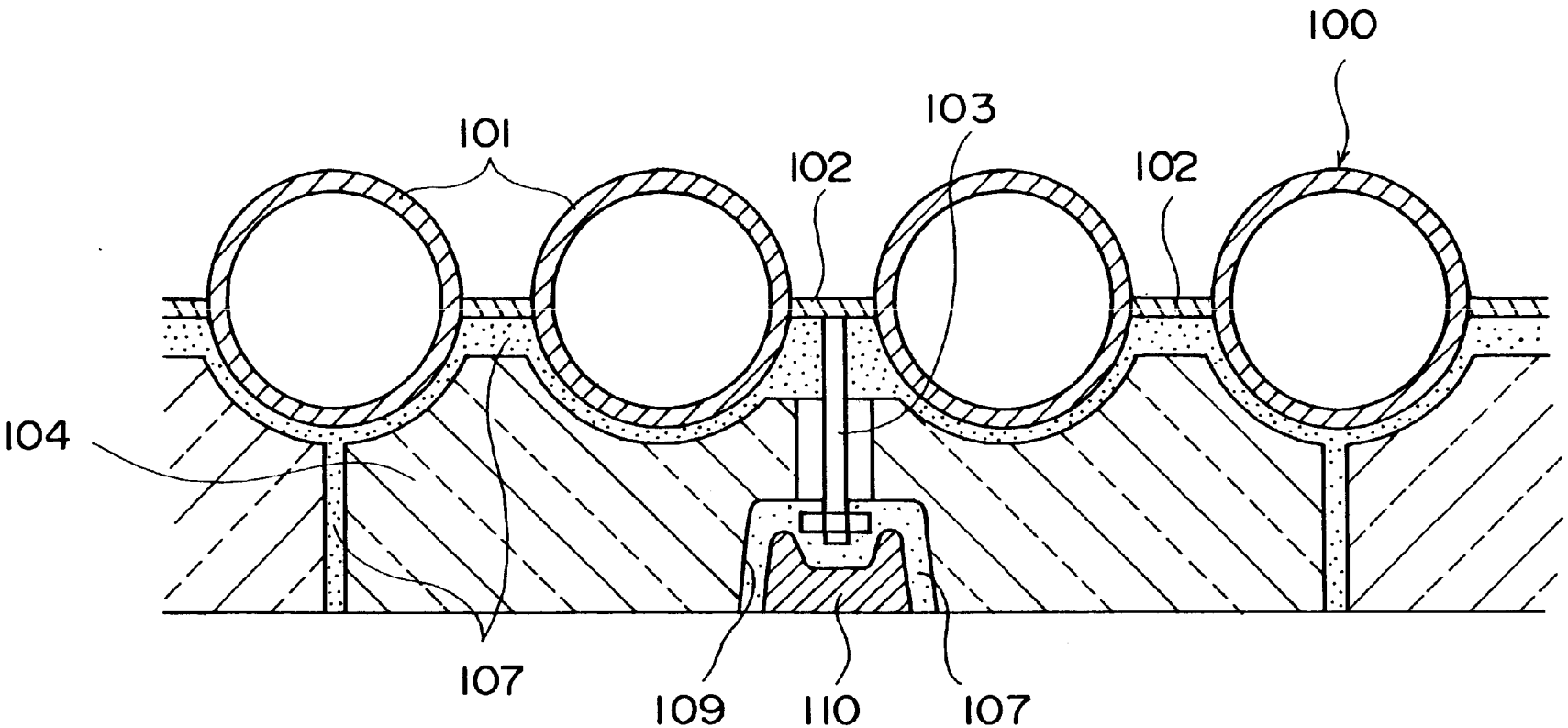
Fig. 9 PRIOR ART
FIG. 9 is a view, also corresponding to FIG. 1, which shows another heat-resistant shield for protecting boiler tubes which is a further example of the prior art (Patent Publication 2-203194).

FIGS. 5 through 7 show a second preferred embodiment of this invention. In all three drawings, a tapered tongue and recess serve as the interlocking attachment means.

In the embodiment pictured in FIG. 5, adjacent tubes are linked by a flat rib. As has been discussed, 12 is a tube assembly comprising multiple rows of tubes 11 and the flat rib 13 which connects the adjacent tubes 11 in either a horizontal or a vertical array.

56 is a heat-resistant block which shields the entire outer surface of tube assembly 12 from the combustion gases. The heat-resistant block 56 is produced by placing in a mold a material with relatively good thermal conductivity, such as a castable material. The block comprises curved portions 56*a,* which shield the surface of the boiler tubes 11, and flat connecting portions 56*b,* which extend from the curved portions 56*a* along the flat ribs 13 of the tube assembly. These aspects of the design are identical to corresponding aspects of the first embodiment.

In this embodiment, heat-resistant block 56 is mounted to the tube assembly by round, tapered recess 58, formed on the surface of flat rib 13 of tube assembly 12 opposite flat connecting portion 56*b*. Recess 58 is formed, as can be seen in the cross section taken along line A—A, using ring-shaped taper guide 58*a*. The area in the center of the guide serves as recess 58.

Indentation 59*a,* a round hole which tapers along its depth, is in the location opposite hollow ring 58 on flat portion 56*b* of heat-resistant block 56, on the side which faces flat rib 13 of tube assembly 12.

Tapered protrusion 59 on heat-resistant block 56 is pressed into tapered recess 58 on flat rib 13 until the block is interlockingly secured onto the tube assembly.

The small space left between heat-resistant block 56 and flat rib 13 is filled with mortar 20.

FIGS. 6 and 7 show another embodiment of this invention in which boiler tubes 11 are connected to each other by flat ribs in a parallel array.

FIGS. 6 and 7 differ from FIG. 5 in that boiler tubes 11 in these figures are completely surrounded by an atmosphere of combustion gases. Thus the entire surface of tube 11 must be shielded by heat-resistant block 66.

In this case block 66 comprises two segments which meet along the vertical axis to cover the entire periphery of the aforesaid tube 11. These segments, 66A and 66B,have semicircular cross sections. Tapered recess 68 and tapered projection 69 constitute the interlocking attachment means which secures the block to the tube in such a way that it can be mounted or released. These interlocking attachment means are placed where shroud segments 66A and 66B meet the outer surface of the tube assembly.

In this embodiment, one square tapered recess 68 is provided on either side of the outer surface of tube 11 so that the interlocking attachment means are disposed in the centers of the inner surfaces of shroud segments 66A and 66B.

As can be seen in the cross section in FIG. 7, which is taken along line B—B, square taper guides 68*a* project from the surface of the tube, and the areas within the taper guides constitute tapered recesses 68.

Shroud segments 66A and 66B each have a thicker portion 63 in the location which corresponds to tapered recess 68. On the side of the thicker portion 63 which faces the aforesaid tapered recess 68 is a tapered projection 69 which is formed by creating square tapered recess 69*a* in the surface of the shroud.

The aforesaid tapered recesses 68 and tapered projections 69 may be circular, square, or polygonal according to the user's discretion.

When tapered projections 69 on shroud segments 66A and 66B are pressed into tapered recesses 68 on tube 11, the shroud is interlockingly secured to the tube.

The small space which remains between heat-resistant block 66 and tube 11 or flat rib 13 is filled with mortar 20.

Small clearances 651 and 652 should be left between the free ends of shroud segments 66A and 66B in both the peripheral and axial directions. This will prevent the segments from colliding with each other due to thermal expansion and so prevent thermal warping or other damage.

EFFECTS OF THE INVENTION

As has been discussed above, with this invention a heat-resistant block is interlockingly secured to a boiler tube assembly by an interlocking attachment means whose two segments are provided on the surfaces of the block and tubes which face each other, and which allows the block to be attached (interlockingly secured) to or removed from the tube assembly. This interlocking attachment means may, for example, comprise a tapered tongue and recess which allow the block to be hung on the tube assembly taking advantage of the force of gravity to secure it, much as a picture is hung on a wall. This design dispenses with the bolt and nut used in the prior art, which were exposed to the combustion gases, and so prevents high-temperature corrosion from occurring.

Because the block is mounted by means of interlocking attachment means which can become looser or tighter instead of a bolt and nut, it never becomes frozen to the tube assembly due to thermal expansion. The block can be made thinner, and the temperature differential between the inner and outer surfaces of the block is smaller than in prior art devices. Temperature spiking is controlled, and the resulting thermal stress on the block is reduced.

The aforesaid heat-resistant block comprises a tubular shroud which conforms to the surface of the tube assembly. This design allows the block to be relatively thin and of a uniform thickness throughout. The block has high thermal conductivity and so can transfer thermal energy effectively to the tubes. It does not overheat and so does not experience a buildup of ash on the surface which is exposed to the combustion gases, as prior art blocks did. This block is thus able to maintain high thermal conductivity.

With this invention, gases which cause high-temperature corrosion are effectively prevented from infiltrating the interlocking attachment means from the combustion gas chamber. In addition, the gap between the block and the tube assembly is uniform, so the layer of mortar which fills the gap cannot become excessively thick in any location.

With this invention, the heat-resistant block can easily be mounted and removed. It is also easy to handle (i.e., to carry).

We claim:

1. A heat-resistant assembly for protecting boiler tubes from combustion products, having a heat-resistant block structure between boiler tubes and combustion gases to shield said boiler tubes from combustion products, comprising:

a heat-resistant block having a curved shroud portion formed in a thin arc section with a substantially uniform thickness so that an inner surface of said heat-resistant block faces said boiler tubes and effectively shields the tubes from said combustion products, at least one surface of said heat-resistant block facing said boiler tubes being curved along said boiler tubes; and an interlocking attachment means between said heat-resistant block and said boiler tubes, which can be engaged or released, to interlockingly attach said heat-resistant block and said boiler tubes.

2. A heat-resistant assembly for protecting boiler tubes according to claim 1, wherein said boiler tubes are connected by a flat rib, said heat-resistant block comprises a plurality of curved shroud portions formed in thin arc sections with substantially uniform thickness and a flat connecting portion which extends from the curved portion along said flat rib to shield said flat rib, and said interlocking attachment means, which can be engaged or released, is provided between said flat rib of said boiler tubes and said flat connecting portion of said heat-resistant block.

3. A heat-resistant assembly for protecting boiler tubes according to claim 1, wherein said heat-resistant block covers an entire periphery of said boiler tubes when assembled and comprises a plurality of curved shroud portions extending along an axial direction of said boiler tubes, and said interlocking attachment means, which can be engaged or released, is provided between said curved shroud portions and said boiler tubes.

4. A heat-resistant assembly for protecting boiler tubes according to claim 1, wherein said interlocking attachment means comprises a tongue provided on said boiler tubes and a recess provided in said heat-resistant block, the recess being formed in a thick part encompassing said interlocking attachment means.

5. A heat-resistant assembly for protecting boiler tubers according to claim 4, wherein heat-resistant the thickness of the block at the recess is substantially equal to that of the curved shroud portion.

6. A heat-resistant assembly for protecting boiler tubes according to claim 1, wherein a tapered recess formed in a thick part and a tapered tongue provided on the boiler tube are fitted together so as to interlock the heat-resistant block to the boiler tubes.

* * * * *